US011391043B2

(12) United States Patent
Fracassi

(10) Patent No.: US 11,391,043 B2
(45) Date of Patent: Jul. 19, 2022

(54) MODULAR SYSTEM AND KIT FOR THE DRY BUILDING OF STRUCTURES FOR CONSTRUCTIONS, AS WELL AS A BUILDING METHOD THEREOF

(71) Applicant: Isinnova S.r.l., Brescia (IT)

(72) Inventor: Cristian Fracassi, Brescia (IT)

( * ) Notice: Subject to any disclaimer, the term of this patent is extended or adjusted under 35 U.S.C. 154(b) by 533 days.

(21) Appl. No.: 16/336,663

(22) PCT Filed: Sep. 29, 2017

(86) PCT No.: PCT/IB2017/056007
§ 371 (c)(1),
(2) Date: Mar. 26, 2019

(87) PCT Pub. No.: WO2018/060946
PCT Pub. Date: Apr. 5, 2018

(65) Prior Publication Data

US 2021/0293019 A1 Sep. 23, 2021

(30) Foreign Application Priority Data

Sep. 29, 2016 (IT) ..... 102016000098004
Feb. 24, 2017 (WO) ..... PCT/IB2017/051073

(51) Int. Cl.
*E04B 2/70* (2006.01)
*E04B 1/26* (2006.01)
(Continued)

(52) U.S. Cl.
CPC ..... *E04B 2/709* (2013.01); *E04B 1/26* (2013.01); *E04B 2/707* (2013.01); *E04B 7/04* (2013.01);
(Continued)

(58) Field of Classification Search
CPC ..... E04B 1/26; E04B 2001/262; E04B 2/70; E04B 2/707; E04B 2/709; E04B 7/04; E04C 2/386; E04C 2/422; E04C 2/423
(Continued)

(56) References Cited

U.S. PATENT DOCUMENTS 1,448,244 A * 3/1923 Wilson ..... E04B 1/26 52/92.1
1,887,814 A * 11/1932 Le Gall ..... E04C 2/36 52/793.11
(Continued)

FOREIGN PATENT DOCUMENTS

FR 2736073 1/1997
FR 2736073 A1 * 1/1997 ..... E04B 1/26
(Continued)

OTHER PUBLICATIONS

Machine Translation of FR2736073, https://translationportal.epo.org/emtp/translate/?ACTION =description-retrieval&COUNTRY=FR &ENGINE=google&FORMAT=docdb&KIND=A1&LOCALE=en_EP&NUMBER=2736073&SRCLANG=fr&TRGLANG=en (Year: 2021 ).*

*Primary Examiner* — Ryan D Kwiecinski
(74) *Attorney, Agent, or Firm* — Themis Law

(57) ABSTRACT

A modular system for the dry building of structures for constructions, such as walls, floors, balconies, roofs or the like, includes a plurality of planar modular beams that define a respective plane and that are mutually jointed, and a plurality of planar panels anchored thereto at least at or in proximity of the end portions of the same planar modular beams.

17 Claims, 5 Drawing Sheets

(51) Int. Cl.
*E04B 7/04* (2006.01)
*E04C 3/14* (2006.01)
*E04C 3/36* (2006.01)

(52) U.S. Cl.
CPC ..... *E04C 3/14* (2013.01); *E04C 3/36* (2013.01); *E04B 2001/262* (2013.01)

(58) Field of Classification Search
USPC ..... 52/793.11
See application file for complete search history.

(56) References Cited

U.S. PATENT DOCUMENTS 2,589,879 A * 3/1952 Sheppard ..... E04B 2/707 52/762
3,807,116 A * 4/1974 Flynn ..... E04C 2/36 428/116
4,894,974 A * 1/1990 Mayhew ..... E04C 2/36 52/782.2
5,157,892 A * 10/1992 Ryther ..... E04C 2/36 52/793.11
7,114,300 B1 * 10/2006 Culp ..... A47B 47/042 211/186
8,458,980 B2 * 6/2013 Ivanov ..... A63H 33/084 446/105

FOREIGN PATENT DOCUMENTS

WO 2012083391 6/2012
WO 2017162500 9/2017

* cited by examiner

MODULAR SYSTEM AND KIT FOR THE DRY BUILDING OF STRUCTURES FOR CONSTRUCTIONS, AS WELL AS A BUILDING METHOD THEREOF

FIELD OF THE INVENTION

The present invention is generally applicable in the field of civil engineering and it relates in particular to a system and a kit for the dry building of structures for constructions, i.e. without using concrete, adhesive, resins or other similar bonds.

The invention also relates to a method of building such building constructions.

BACKGROUND OF THE INVENTION

Modular elements which may be reciprocally coupled for the dry building of structures for constructions, in particular walls and/or floors of house are known.

Such modular elements generally have an elongated longitudinal shape, such as axes, beams, and/or columns, which are coupled to each other by male-female coupling systems to provide a reticular load bearing structure and thus more generally a building, an house or the like.

This structures of buildings have limited structural strength and in particular low strength to horizontal forces, such as forces acting on the wall due to wind, earthquakes, or loads of one or more people leaning on the same wall.

In order to stiffen the load-bearing structure, systems are known which comprise a plurality of stiffening elements, such as beam and/or tie rods, arranged along predetermined directions generally transverse to the beams and columns directions, in order to stiffen the supporting structure so as to improve its resistance along predetermined directions.

However, such stiffening elements have a limited effect on the mechanical resistance of the whole structure and furthermore the strength of the latter is not homogeneous with zones having greater resistance and zones having less resistance.

Furthermore, such stiffening elements cause wall and/or floor thickening for increasing the bulkiness and/or for compromising the aesthetic appearance of the whole building.

Modular elements having substantially planar shape are also known, i.e. planar modular elements having an outer shape so that when they are coupled with other planar modular elements in a predetermined way, they form a substantially full load bearing structure.

However, the planar modular elements are not easily movable, thus making the transportation and assembly costly, and having different shape depending on the building structures to be built. In other words, the structures of building construction so built need to nip a planning in the bud and do not allow to modify the configuration of the structure once built and/or to reuse such planar modular elements to make structures having different configurations.

Furthermore, both for the insulation elements installation and for the systems placement, it is necessary to build a false-wall and/or false-floor or it is necessary to intervene on the same structure, for example by forming a plurality of holes or grooves in the panels.

Such operations are particularly costly, compromise the structural rigidity of the whole structure and make difficult to reuse the modular elements to build structures of different configurations.

SUMMARY OF THE INVENTION

An object of the present invention is to at least partially overcome the above-mentioned drawbacks by providing a modular system for the dry building of structures for constructions having features of high functionality and low cost.

Another object of the present invention is to provide a modular system for the dry building of structures for constructions that allows a reconfiguration thereof.

Another object of the present invention is to provide a modular system for the dry building of structures for constructions in a simple and fast way.

Another object of the present invention is to provide a modular system for the dry building of structures for constructions having a high mechanical resistance.

Such objects, as well as others that will appear more clearly hereinafter, are fulfilled by a system, kit, and method for the dry building of structures for constructions having one or more of the features herein described, shown and/or claimed.

The dependent claims describes advantageous embodiments of the invention.

BRIEF DESCRIPTION OF THE DRAWINGS

Further features and advantages of the invention will become more apparent by reading the detailed description of a preferred but not exclusive embodiments of the invention, shown as non-limiting example with the help of the annexed figures, in which.

DETAILED DESCRIPTION OF SOME PREFERRED EMBODIMENTS

Referring to the figures cited above, a modular system 1 is described for the dry building of structures for constructions 2 such as walls, floors, balconies, roofs or the like.

The structure 2 may be a load bearing structure or not.

In this document, the term "structure" or similar means an assembly of structural elements which by its nature is suitable to support compression, traction and cutting stress.

In this document, the term "building construction" or similar means a structure or an assembly of two or more structures for the building of a building construction, whether it is a building structure or a nonbuilding structure.

Figure 1:
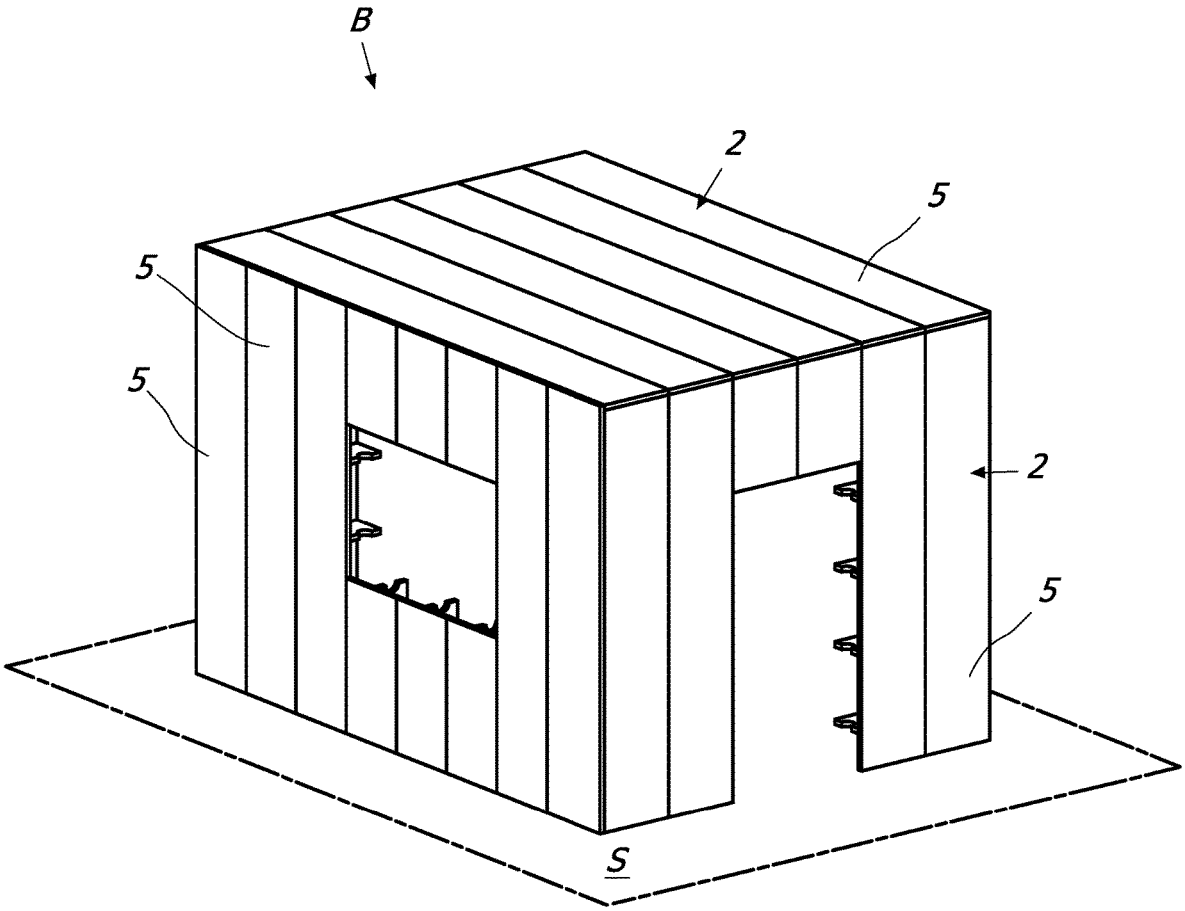
FIG. 1 is an axonometric view of an embodiment of a building B.
Figure 2:
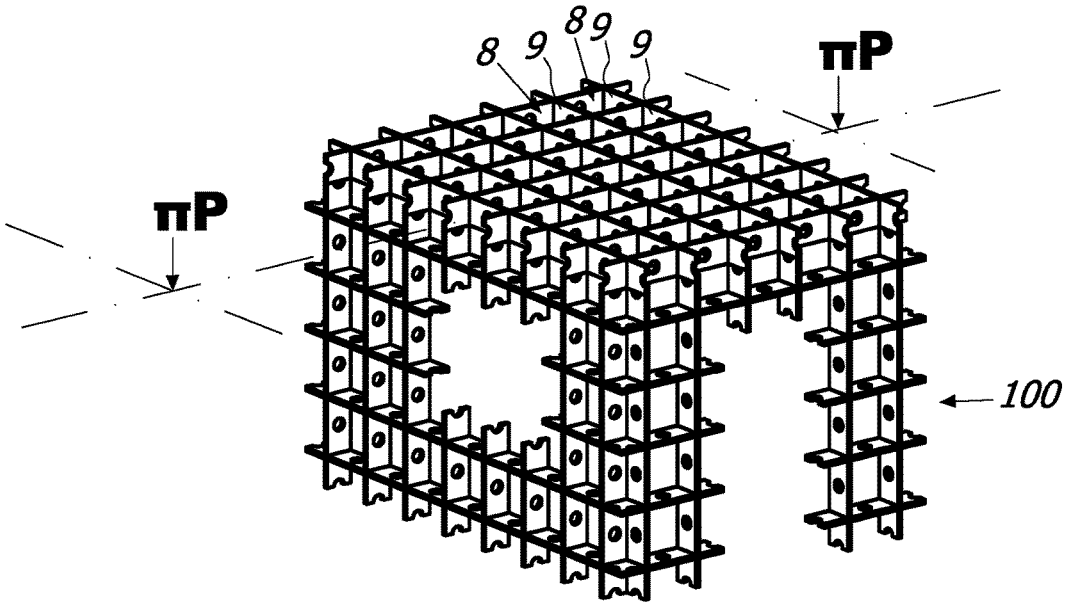
FIG. 2 is an axonometric view of the building B of FIG. 1 without the panels 5.

As schematically shown in FIG. 1, the structures 2 may be connected to each other in a per se known manner for building a building construction B, such as houses, garages or the like, lying on a supporting surface S such as a ground. Possibly, known means for reciprocally connecting the structures 2 such as plates, angles or the like may be provided.

Figure 7:
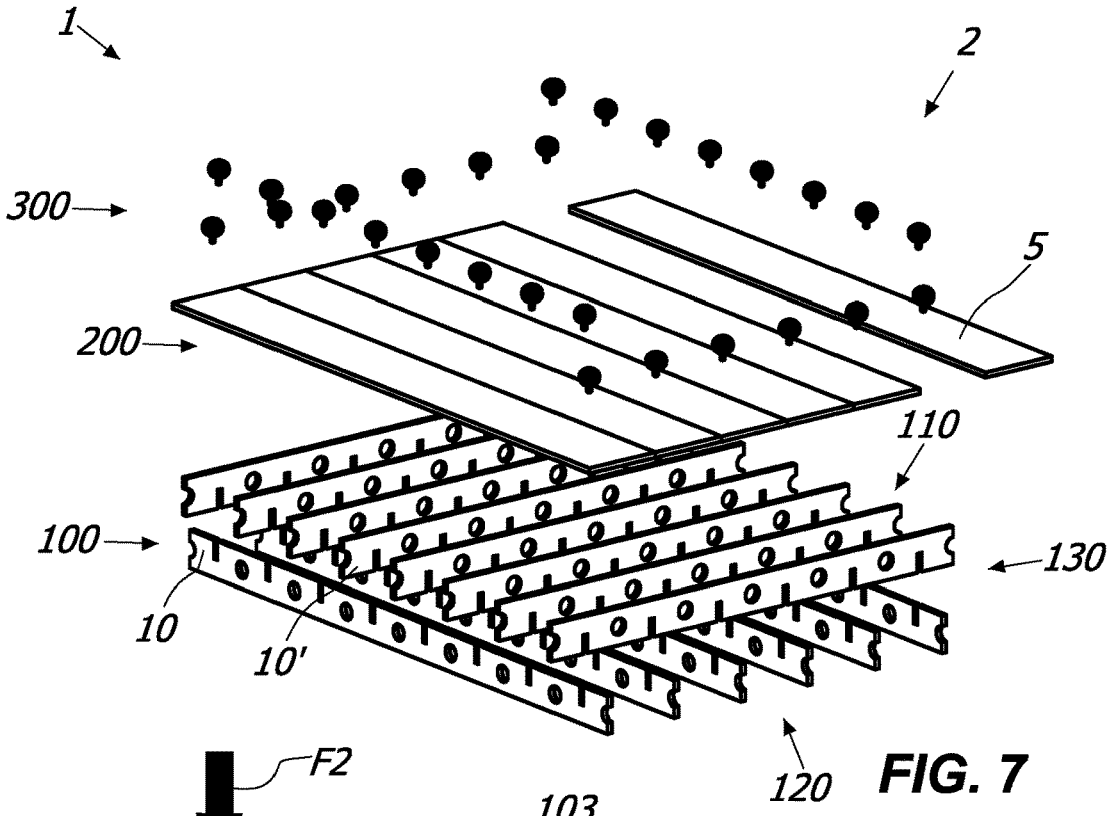
FIG. 7 is an exploded axonometric view of the structure 2.

As particularly shown in FIG. 7, the structure 2 may be essentially formed by a reticular structure 100 and a planar structure 200, reciprocally anchored by anchoring means 300.

The reticular structure 100 may be formed by a plurality of modular axes 10, 10', which may be reciprocally jointed, preferably in a removable manner. Once jointed the modular axes 10, 10' may be flush with each other.

More in detail, the axes 10, 10' may be substantially planar to define a respective plane ππ' and may have substantially longitudinal development to define a respective longitudinal axis X, X'.

For example, the modular axes 10, defining plane π and longitudinal axis X, may be substantially vertical, whereas the modular axes 10', defining plane π' and longitudinal axis X', may be substantially horizontal.

However, it is understood that the modular axes 10, 10' may have any orientation and any reciprocal angle without departing from the scope of the invention defined by the annexed claims.

Each modular axis 10, 10' may have two end portions 101, 102 and a central portion 103.

Suitably, once the axes 10, 10' are jointed, the latter may cooperate to define the main development plan πP of the reticular structure 100.

Figure 3:
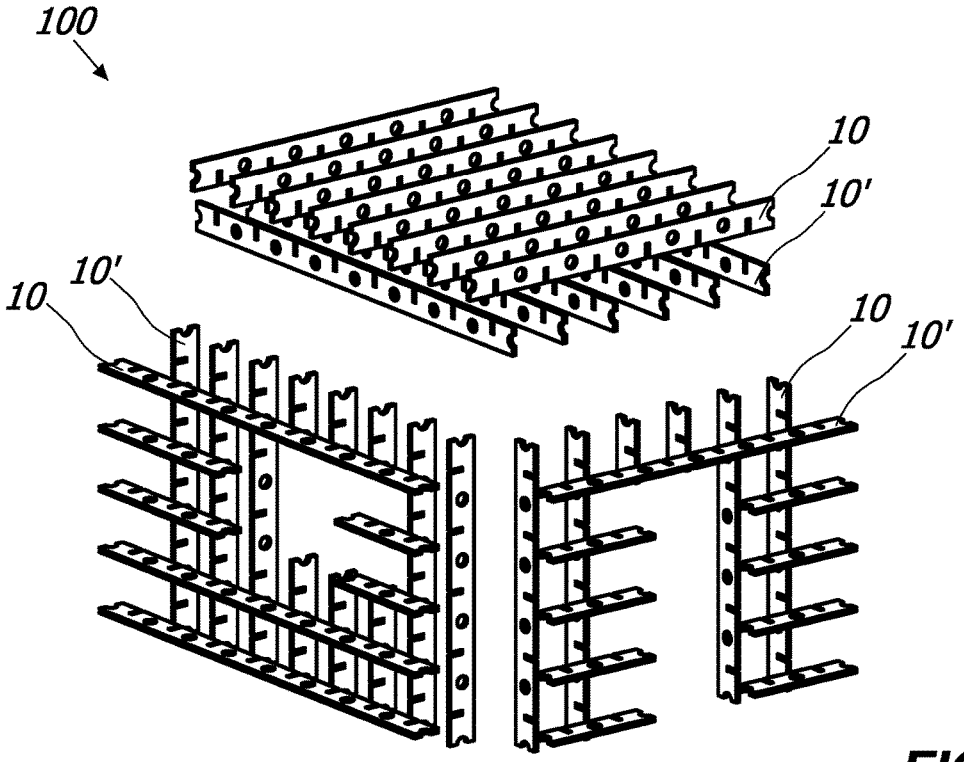
FIG. 3 is an exploded view of some reticular structures 100.

To this end, as shown in FIG. 3, each axis 10, 10' may comprise a plurality of jointing zones 11, 11' which may preferably be equidistant each other so that each axis 10 joins a plurality of axes 10' to form the reticular structure 100.

Suitably, the jointing zone 11 may comprise at least one male element 12 and at least one female element 13 susceptible to engage with corresponding female 13' and male 12' elements of a respective jointing zone 11' of another modular axis 10'.

Figure 4A:
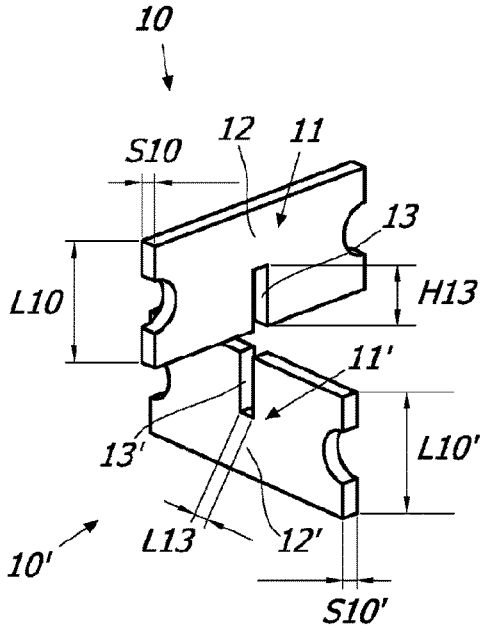
FIGS. 4A and 4B are an axonometric view of some details of two modular axes 10, 10' respectively disjointed and jointed.
Figure 4B:
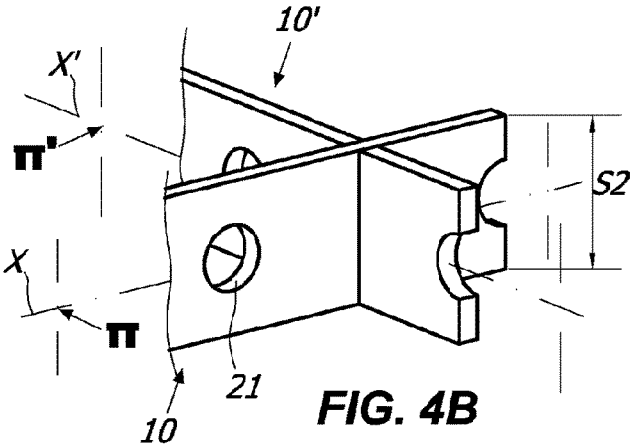

As particularly shown in FIG. 4B, the male and female elements 12, 13 are configured so that when the same male and female elements 12, 13 of two different axes 10, 10' are engaged, the respective planes π, π' thereof are substantially perpendicular to each other and perpendicular to the plane πP.

Moreover, the engagement between the male and female elements 12, 13 of two modular axes 10, 10' may be of a removable type so as to allow an operator to join/disjoin the axes 10, 10'.

Thanks to this feature, once the construction B is built, it may be possible to expand, reconfigure or even dismantle the latter and reuse the axes 10, 10' for a different construction B.

Possibly, as schematically shown in FIG. 3, the axes 10, 10' may have different lengths to form reticular structures 100 having different configurations, for example, the reticular structures 100 may have space for a door, window or the like. In this way, complex constructions B may be built.

Figure 5:
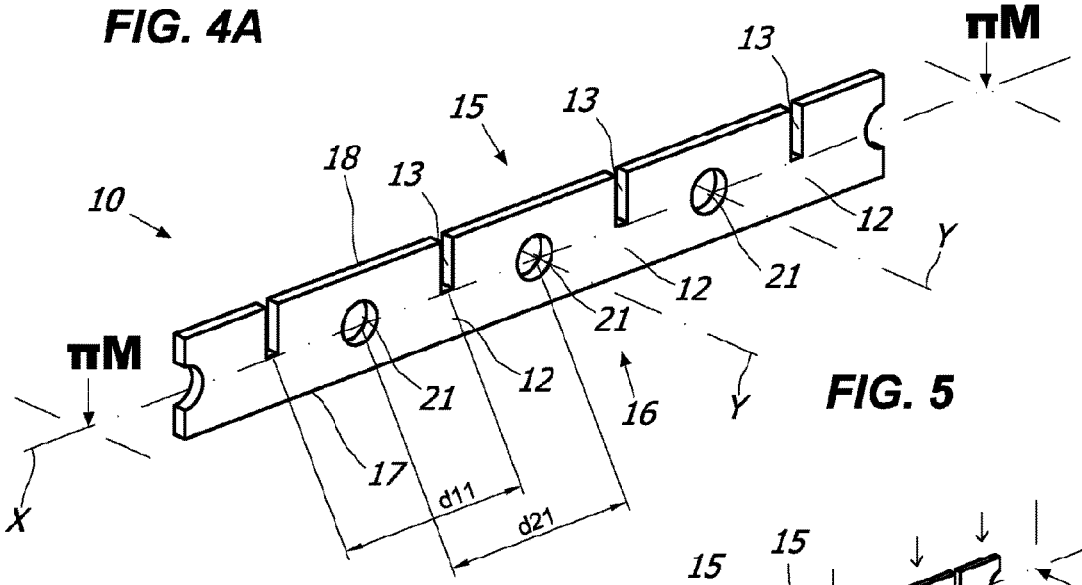
FIGS. 5 and 6 are axonometric views of different embodiments of the modular axis 10.

In any case, each of the jointing zones 11, 11' may include a portion 15 and an opposite portion 16. In particular, as shown in FIG. 5, the portions 15, 16 may be opposed to a median plane πP substantially perpendicular to the planes π, π' of the axes 10, 10'.

The portion 15 may include one of the male and female element 12, 13, whereas the portion 16 may include the other of the male and female element 12, 13. For example, as shown in FIG. 5, the portions 15 may include the female element 13, whereas the portions 16 may include the male element 12. In other words, the female element 13 and the male element 12 may all be faced to the opposite sides of the axis 10, 10' along the whole extension thereof.

Figure 6:
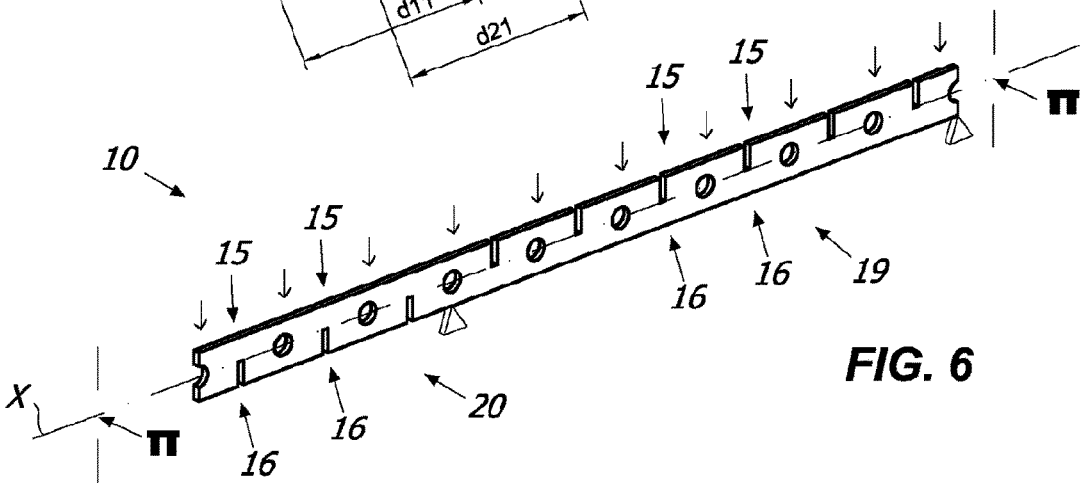

According to a particular embodiment shown in FIG. 6, the axes 10, 10' may comprise a longitudinal part 19 in which the portions 15 of the respective jointing zones 11, 11' lie above the median plane πP and include the female element 13 whereas the portions 16 of the respective jointing zones 11, 11' lie below the median plane πP and include the male element 12. Furthermore, a longitudinal part 20 consecutively to the part 19 may be provided, in which the portions 15 of the respective jointing zones 11, 11' lie above the median plane πP and include the male element 12, whereas the portions 16 of the respective jointing zones 11, 11' lie below the median plane πP and include the female element 13.

In other words, the female elements 13 may be for the first part 19 facing one side of the axis 10, 10' and for the second part 20 facing the opposite side of the same axis 10, 10'.

In this way, cantilever structural elements such as balconies may be easily built. In particular, as schematically shown in FIG. 6, the female elements 13 may be placed on the side of the axis 10, 10' subjected to the compression stress and vice versa the male elements 12 may be placed on the side of the axis 10, 10' subjected to the traction stress.

More in detail, the female element 13 may include or consisting of a groove substantially perpendicular to the longitudinal axis X, whereas the male element 12 may be defined by a substantially continuous portion of the axis 10, 10'.

Suitably, the axes 10, 10' may have a predetermined thickness S10, S10'. On the other hand, as shown in FIG. 4A, the grooves 13 may have a width L13 substantially equal to the thickness S10, S10' of the axes 10, 10' so that once the latter are jointed the clearance therebetween is minimized. Preferably, the clearance may be almost zero.

Furthermore, the grooves 13 may have a depth H13 substantially equal to the half of the width L10 of the axes 10, 10'. Thus, once the axes 10, 10' are jointed, the reticular structure 100 may have a thickness S2 substantially equal to the width L10. In other words, the axes 10, 10' may be flush with each other.

In this way the whole reticular structure 100 may structurally cooperate with the planar structure 200.

Both the main portions 110, 120 of the reticular structure 100 may thus be substantially plane and may have a development substantially parallel to the main development plan πP. The main portions 110, 120 may be connected to each other by the lateral portions 130.

Suitably, the modular axes 10, 10' may be all equal to each other so as to facilitate the stock storage and to minimize the cost.

Advantageously, the modular axes 10, 10' may further be symmetrical with respect to a median plane perpendicular to the planes π, π', so as the modular axes 10, 10' may be used regardless of the orientation, i.e. upright or upside down.

In a preferred but not exclusive embodiment the modular axes 10, 10' may furthermore have end portions 101, 102 having the same configuration, so as the modular axes 10, 10' may be used upright or upside down.

The anchoring means 300 may be anyone, for example glue or a plurality of screws, nails or similar elements.

Preferably, such anchoring means 300 may be completely or at least partially removable so as to allow an operator the at least partial removal thereof for varying the configuration of the construction B or of part thereof.

Suitably, the system 1 may comprise a plurality of planar panels 5 anchorable to the modular axes 10, 10' by the anchoring means 300. The panels 5 may be faced to each other to form the planar structure 200, which may define a plane π".

It is understood that although in the annexed figures the panels have a parallelepiped and generally elongated shape, they may be of any shape. For example, the panels may be substantially square and may be placed side by side both along the axes 10 and the axes 10'.

More specifically, each planar panel 5 may have a pair of substantially parallel opposite main faces 210, 220 and a plurality of lateral edges 230, preferably in mutual contact.

However, it is understood that panels may also be operatively connected to each other.

In this text, the term "operatively connected" and its derivatives means that two or more elements are connected by any means susceptible to transfer the stresses exerted on an element to the adjacent ones. For example, a spacer or a layer of glue may be interposed between the panels.

It is understood that once the planar panels 5 are reciprocally placed side by side, the opposite main faces 210, 220 of each planar panels 5 may define the corresponding main opposite faces of the whole planar structure 200, whereas the juxtaposed peripheral lateral edges 230 may define the peripheral lateral edges of the whole planar structure 200.

In any case the panels 5 may have the main face 220 in contact or operatively connected with the main plane portion 110 of the reticular structure 100, so that the latter and the planar structure 200 are anchored to each other.

Figure 8:
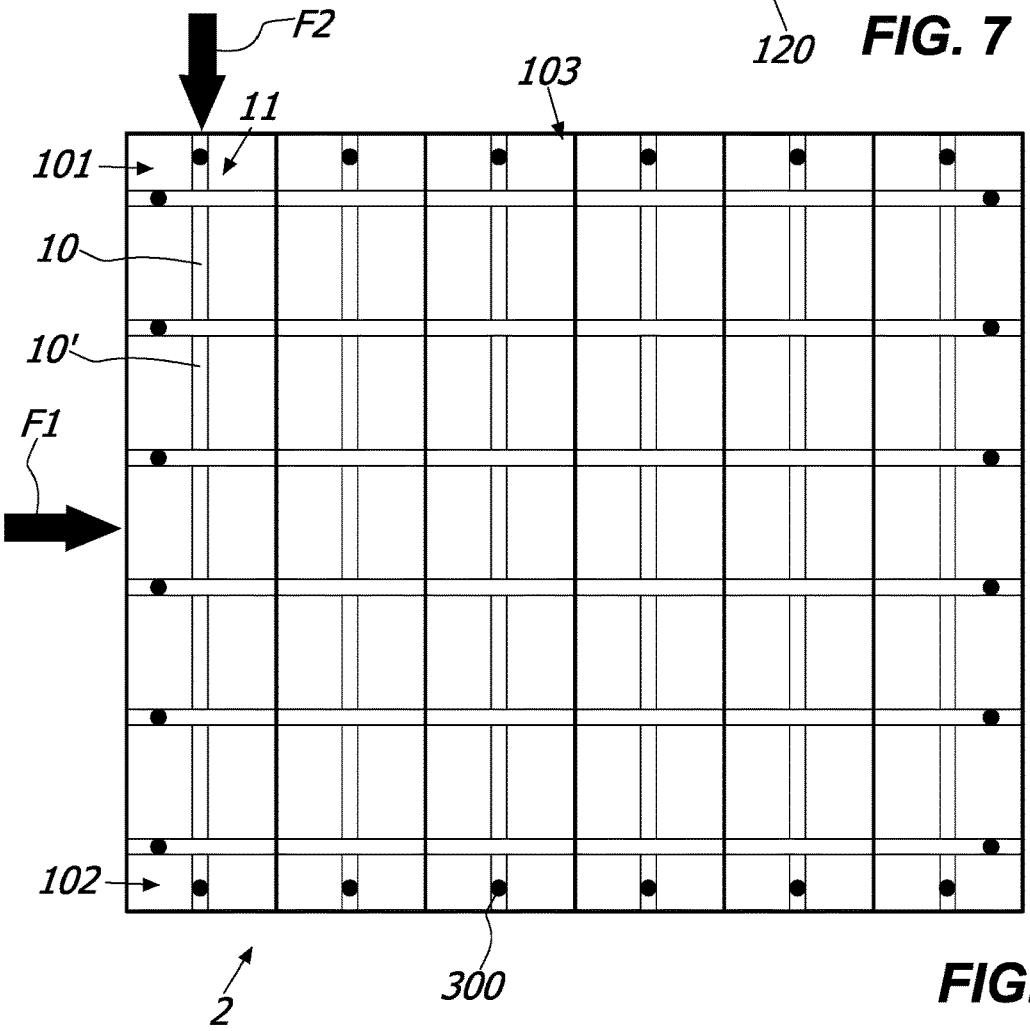
FIG. 8 is a top view of an embodiment of the assembled structure 2.
Figure 9:
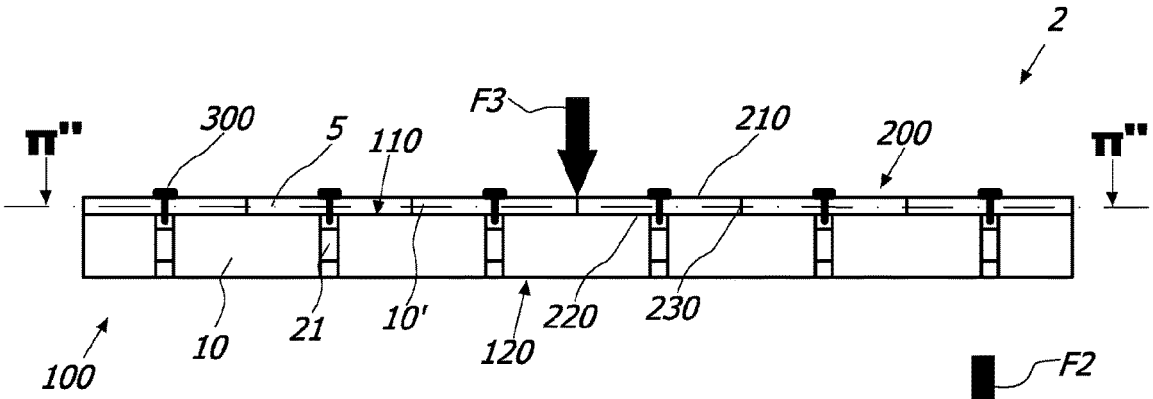
FIGS. 9 and 10 are different side views of the embodiment of the structure 2 of FIG. 8.

Advantageously, as particularly shown in FIG. 8, such anchorage may be at least in correspondence or in proximity of the end portions 101, 102 of each modular axis 10, 10'. For example, in case the anchoring means 300 are defined by nails or screws, the latter may be placed as above described.

In this way, several advantages may be provided.

First of all, the planar structure 200 may act as brace for the reticular structure 100 counteracting the lateral forces F3 and preventing that the same reticular structure 100 deforms itself.

Moreover, the planar structure 200 may prevent the inflection of the modular axes 10, 10' in case of axial load F2 on one or more thereof. For example, if the structure 2 is a wall, the axial load F2 imparted by the floor on the vertical modular axes 10 may be effectively counteracted by the planar structure 200 anchored as above described, preventing that the same vertical modular axes 10 become instable.

Apparently, the above may analogously happen in case of lateral loads for the horizontal axes 10', e.g. during an earthquake.

Furthermore, thanks to the above described features, the planar structure 200 may cooperate with the reticular structure 100 to support the compression in the case of normal load F3 acting on the same planar structure 200, for example in case of structure 2 configured as a floor or during an earthquake.

Advantageously, if necessary the planar structure 200 may be reciprocally anchored with the plane modular axes 10, 10' even in correspondence of the central portion 103 thereof.

Figure 11:
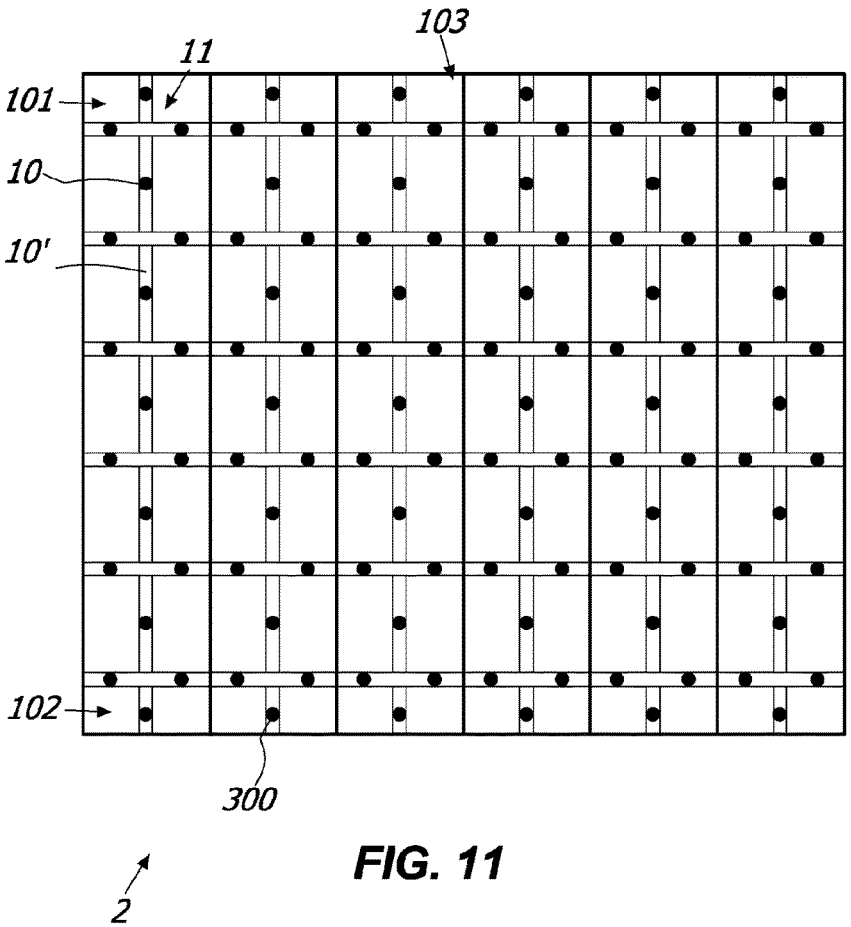
FIG. 11 is a top view of another embodiment of the assembled structure 2.

In a preferred but not exclusive embodiment, for example shown in FIG. 11, each of the plane modular axes 10, 10' may include anchoring means 300, for example one or more screws or nails, between each consecutive pair of jointing zones 11.

Advantageously, both the reticular structure 100 and the planar structure 200 may rest on the supporting surface S or may be connected thereto in any manner. In this way, distributing the load of the construction B equally along the whole supporting surface, the overloading of the vertical modular axes 10 may be prevented.

More particularly, one of the lateral portions 130 of the reticular structure 100 and one or more lateral edges 230 of one or more of the planar panels 5 (depending on the configuration thereof) may be in contact or operatively connected with the supporting surface S.

It is understood that in addition to the above structural function, the planar panels 5 may even have aesthetic function and/or protection function and/or thermal insulation function and/or sound insulation function and/or protection function against atmospheric and/or similar events.

The panels 5 may be internally and/or externally coupled to the axes 10, 10', so as to be substantially parallel or coincident with the main development plane πP.

However, the panels 5 may be preferably coupled externally to the reticular structure 100, whereas cover elements 5' of a known type, for example made of plasterboard, plastic, metal, chipboard or OSB (Oriented Strand Board), may be placed at the inner side of the reticular structure 100.

According to a further aspect of the invention, the axes 10, 10' may comprise a plurality of passing through openings 21, for example holes, having an axis Y substantially transverse to the plane π, π' of each modular axis 10, 10' to allow the passage of installations and/or pipes.

In more detail, the reticular structure 100 may include a plurality of quadrangular cells 8, which may house pipes, installations and/or insulating elements P. In particular, the cells 8 may have walls 9 defined by the zone interposed between two jointing zones 11, 11' of each modular axis 10, 10'.

Preferably, as shown in the annexed figures, each of the walls 9 may be defined by two consecutive jointing zones 11, 11'. In this case, the cells 8 may be substantially square.

More in detail, two consecutive holes may have a predetermined reciprocal distance d21, which may be essentially equal to the distance d11 between two jointing zones 11, 11' so that each passing through hole 21 remains interposed between the two consecutive jointing zones 11, 11'.

In this way, each cell 8 may include at least one of the passing through holes 21. Preferably, as shown in the annexed figures, each cell 8 may comprise a plurality of passing through holes 21, e.g. four passing through holes 21.

Suitably, the cells 8 and the pipes, installations and/or insulating elements P within them may remain accessible to the operator even once the structure 2 has been formed.

Figure 10:
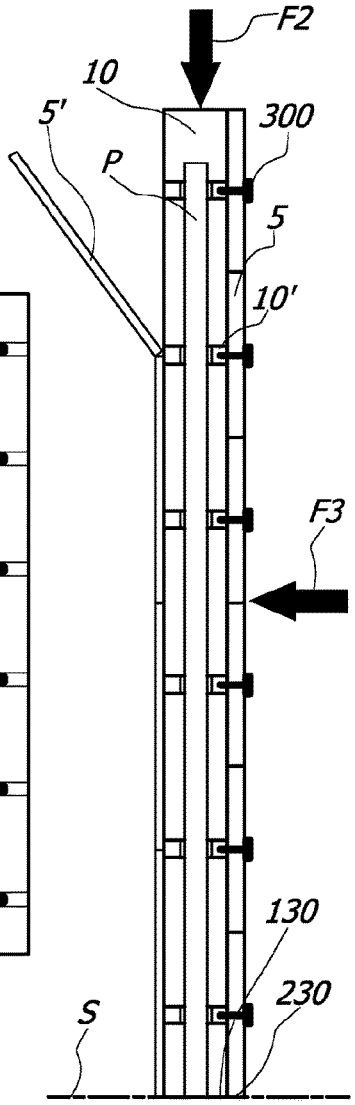

To this end, it is possible e.g. to remove one or more of the internal cover elements 5', as shown in FIG. 10, or to use cover elements 5' and/or panels 5 having one or more inspection windows.

Thanks to these features, maintenance operations may be particularly easy and low cost.

The axes 10, 10' and/or panels 5 may be made of wood or in a material including wood, for example plywood, lamellar wood or multilayer wood.

It is understood that it is not mandatory that the materials of the axes 10, 10' and the one of panels 5 are the same, as well as that not all the axes 10, 10' or all the panels 5 are made of the same material.

For example, the axes 10, 10' may be made of wood whereas the panels 5 may be made of multilayer wood, or the vertical axes 10 may made of wood, the horizontal axes 10' may be made of lamellar wood and the panels 5 may be made of multilayer wood.

Preferably, the axes 10, 10' may made of wood having longitudinally oriented fibers, since it is more suitable for counteract the axial load.

In use, in order to form the structure 2 may be sufficient initially providing the modular axes 10, the planar panels 5 and the anchoring means 300, and then assembling the various parts as above described.

More in particular, initially the modular axes 10 may be jointed and crossed together to form the reticular structure 100 and then anchoring the panels 5 to the latter, taking care to assemble the panels 5 as above described so as to form the planar structure 200.

In this step, the anchoring means 300 on the planar structure 200 may be arranged as above described, for example as shown in FIG. 8 or 11.

As used herein, with the expression "providing" or derivative thereof is meant the preparation of an element of interest to a process step of interest, thus including any preventive treatment act for the optimum exploiting of the same step of interest, from the simple withdrawal and possible storage to pre-heat and/or chemical and/or physical treatments and the like.

From the above description, it is clear that the invention achieves the intended objects.

The invention is susceptible to numerous modifications and variants, all included in the annexed claims. All the details may furthermore be replaced with other technically equivalent elements, and the materials may be different depending on the needs, without departing from the scope of the invention defined by the annexed claims.

The invention claimed is:

1. A modular system for dry building construction structures, comprising:

a reticular structure defining a main development plane;

a planar structure defining a first plane substantially parallel to or coinciding with the main development plane;

a joining system that mutually anchors the reticular structure and the planar structure, wherein the reticular structure comprises a plurality of planar modular beams jointed to each other at a plurality of jointing zones and disposed crossed from each other, each of the modular beams defining a respective second plane substantially perpendicular to the main development plane and the first plane, wherein the planar structure is formed by a plurality of planar panels disposed side by side, wherein the planar structure is anchored with the jointed and crossed planar modular beams at least at or in proximity of end portions thereof, whereby the planar structure:

forms a common structure with the reticular structure, engages the planar modular beams in case of an axial load acting one or more of the planar modular beams, and structurally cooperates with the reticular structure in case of a normal load acting on the planar structure, wherein the planar modular beams:

are all the same, are symmetrical with respect to a median plane perpendicular to a respective second plane so that the planar modular beams are adapted to be used regardless of orientation, and have the end portions having a same configuration, and wherein the reticular structure and the planar structure are comprised in a construction structure made of a plurality of reticular structures and planar structures, the construction structure being supported by a supporting surface, at least some of the reticular structures having a lateral portion in contact with, or operatively connected to, the supporting surface, at least some of the planar panels of the planar structures having at least one lateral edge in contact or operatively connected to the supporting surface.

2. The modular system according to claim 1, wherein the planar structure is anchored to the planar modular beams at a central portion thereof.

3. The modular system according to claim 1, wherein each of the planar modular beams includes anchoring elements between each pair of the jointing zones.

4. The modular system according to claim 3, wherein the anchoring elements are removable.

5. The modular system according to claim 1, wherein the planar modular beams are removably jointed to each other.

6. The modular system according to claim 1, wherein the planar modular beams are flush with each other after being reciprocally jointed.

7. The modular system according to claim 1, wherein the reticular structure includes two substantially parallel opposite main planar portions and a plurality of lateral portions.

8. The modular system according to claim 7, wherein the planar structure is anchored to the jointed and crossed planar modular beams so that one of opposite main faces of the planar panels is in contact or operatively connected with an opposite main planar portion of the reticular structure.

9. The modular system according to claim 1, wherein each of the planar panels has a pair of substantially parallel opposite main faces and a plurality of lateral edges, the planar panels having therebetween at least one lateral edge that is in contact or operatively connected with a neighboring edge.

10. The modular system according to claim 9, wherein the planar structure is anchored to the jointed and crossed planar modular beams so that one of opposite main faces of the planar panels (5) is in contact or operatively connected with an opposite main planar portion of the reticular structure.

11. The modular system according to claim 1, wherein each of the planar panels is anchored to the planar modular beams at at least one jointing zone thereof.

12. The modular system according to claim 1, wherein the jointing zones of each of the planar modular beams are equidistant.

13. The modular system according to claim 1, wherein one or both of the planar modular beams or the planar panels are made of wood or of a material including wood.

14. The modular system according to claim 1, wherein all the longitudinal edges of all planar modular beams on the main development plane are coplanar.

15. A modular system for dry building construction structures, comprising:

a reticular structure defining a main development plane;

a planar structure defining a first plane substantially parallel to or coinciding with the main development plane;

a joining system that mutually anchors the reticular structure and the planar structure, wherein the reticular structure comprises a plurality of planar modular beams jointed to each other at a plurality of jointing zones and disposed crossed from each other, each of the modular beams defining a respective second plane substantially perpendicular to the main development plane and the first plane, wherein the planar structure is formed by a plurality of planar panels disposed side by side, wherein the planar structure is anchored with the jointed and crossed planar modular beams at least at or in proximity of end portions thereof, whereby the planar structure:

forms a common structure with the reticular structure, engages the planar modular beams in case of an axial load acting one or more of the planar modular beams, and structurally cooperates with the reticular structure in case of a normal load acting on the planar structure, wherein each of the jointing zones comprises a plurality of male elements and a plurality of female elements adapted to respectively engage a corresponding plurality of female elements and a plurality of male element of a jointing zone of another planar modular beam, so that the jointed modular beams are reciprocally crossed and define respective second planes disposed substantially transversely to each other, and wherein a first group of the male elements in at least one of the planar modular beams is oriented toward the planar structure and a second group of the male elements in the at least one of the planar modular beams is oriented in an opposite direction, causing the at least one of the planar modular beams to have the first group of the male elements and the second group of the female elements.

16. The modular system according to claim 15, wherein a construction structure made of reticular structures joined to planar structures is supported by a supporting surface, the reticular structure having a lateral portion in contact or operatively connected to the supporting surface, one or more of the planar panels of the planar structure having at least one lateral edge in contact or operatively connected to the supporting surface.

17. The modular system according to claim 15, wherein each of the planar modular beams includes anchoring elements between each pair of the jointing zones.

* * * * *